United States Patent [19]

Brocone et al.

[11] Patent Number: 4,886,476

[45] Date of Patent: Dec. 12, 1989

[54] BODY SURFING BOARD

[76] Inventors: Eric J. Brocone, 817 Oliver, Pacific Beach, Calif. 92103; Dennis L. Miller, 1208 E. 12 Mile Rd., Royal Oak, Mich. 48073

[21] Appl. No.: 229,247

[22] Filed: Aug. 8, 1988

[51] Int. Cl.[4] ..... A63C 15/00

[52] U.S. Cl. ..... 441/65; 441/74

[58] Field of Search ..... 441/65, 74, 66, 67, 441/68; 114/274; D21/228, 236, 237

[56] References Cited

U.S. PATENT DOCUMENTS

| | | | |
|---|---|---|---|
| 4,437,842 | 3/1984 | Conner | 441/74 |
| 4,538,540 | 9/1985 | Cashmere | 441/65 |
| 4,561,664 | 12/1985 | Cashmere | 441/65 |
| 4,629,435 | 12/1986 | Pitcairn | 441/74 |
| 4,752,260 | 6/1988 | Stewart | 441/74 |

FOREIGN PATENT DOCUMENTS

| | | | |
|---|---|---|---|
| 974821 | 9/1975 | Canada | 441/65 |

*Primary Examiner*—Sherman D. Basinger
*Assistant Examiner*—Stephen P. Avila
*Attorney, Agent, or Firm*—Brooks & Kushman

[57] ABSTRACT

A maneuverable body surfing board (10) having a nose portion (14), rearwardly extending base control fins (23) and sidewall control fins (26) for directional control and stabilization. The nose portion (14) is a partially spherical region on the forward end (16) of the body surfing board (10). A bottom portion (18) is formed by two planar surfaces (34) which intersect at a recessed central apex (32). The base control fins (23) are formed on lateral edges (20) of the bottom portion (18). Sidewalls (22) extend upwardly and outwardly from the base control fins (23). The sidewalls (22) are preferably convex and terminate on their upper ends in the sidewall control fins (26). The sidewall control fins include a leading surface (36) which extends outboard of the nose portion (14) and faces forwardly and downwardly and a trailing surface (38) which extends outboard from the sidewalls (22) and faces downward and rearwardly. A top surface (28) extends between the sidewalls (22) and includes a torso-receiving recess (30) upon which a person using the board (10) lays. A body surfing board (10) is formed by roto-casting a polypropylene shell which is filled with a polyurethane foam.

20 Claims, 1 Drawing Sheet

BODY SURFING BOARD

TECHNICAL FIELD

This invention relates to an apparatus for use by a person riding waves in a prone position. More particularly, this invention relates to a body surfing board having improved maneuverability.

BACKGROUND OF THE INVENTION

A popular form of recreation in coastal areas is body surfing. The term "body surfing" generally refers to the sport of swimming with a wave as the wave breaks so as to be propelled by the force of the wave towards shore. Body surfing is preferably done with a floatation device. Small inflatable rafts and polystyrene foam kickboards have been used in the past.

Floatation devices keep the body surfer on the surface of the water, allowing the surfer to more efficiently "ride" the wave. Such devices permit a body surfer to rest while waiting for the right wave.

Generally, floatation devices used by body surfers have not provided steering or directional control necessary for steering within the tunnel of a wave. Body surfers have been denied the thrill "tubing" that stand-up surfers were able to achieve due to their greater maneuverability. The dynamic forces within the tunnel of a wave can quickly tumble or capsize a conventional floatation device. A surfer on a surfboard uses the edge of the surfboard and a central base stabilizing fin to control the location of the board relative to the face of the wave. The key to body surfing in the tunnel of a wave is maintaining control by turning up or down the face of the wave to maintain control.

Ideally, a floatation device for body surfing would be attractive, easy to swim with, and durable enough to withstand the pounding of the surf.

The above problems are solved and the objectives and advantages referred to above are achieved by the surf sled of the present invention as will be more fully described below.

SUMMARY OF THE INVENTION

The invention comprises a body surfing board for riding water waves which includes a specially contoured bottom and sidewalls that define control fins that can be used for steering. The body surfing board is a rigid buoyant body. The forward end of the board is formed by a nose portion. The board has a bottom portion which extends rearwardly from the nose portion. The bottom portion has two lateral edges from which a pair of base control fins extend. The base control fins diverge in the rearward direction and extend below the bottom portion. The body surfing board includes a pair of sidewalls which extend rearwardly from the nose portion and upwardly relative to the base control fins. The sidewalls each have an upper edge that defines a sidewall control fin. The top surface of the board has a torso-receiving recess located behind the nose portion and between the sidewalls.

The nose portion is preferably partially spherical region. The body surfing board is formed of a lightweight buoyant material such as a polyurethane foam. The nose portion is enlarged to provide increased front end buoyancy and is curved to facilitate maneuvering the body surfing board. The bottom portion is a broad substantially flat region and preferably includes a recessed central apex formed by the intersection of two planar surfaces. The two planar surfaces increase in width toward the rear of the body surfing board. The bottom portion is bounded on lateral edges by the base control fins which provide an edge for turning the body surfing board by a person using the board by simply shifting the persons center of gravity laterally over one of the control fins.

A key feature of the present invention is the configuration of the sidewalls. The sidewalls are convexly curved between the base control fins and the sidewall control fins. The curvature of each sidewall is substantially generated about an axis. The two axes of the two sidewalls converge in the direction of the nose portion. The convex curvature of the sidewalls permits quick turning when the weight of the person using the board is centered over the sidewall. The sidewall is provided with an upper edge which with the base control fin may be employed to increase or decrease the sharpness of a turn respectively when the center of gravity of the person using the board is shifted relative to the sidewall.

The sidewall control fins are especially formed to define a leading surface and a trailing surface. The leading surface of the sidewall control fin extends outboard of the nose portion and faces downwardly and forwardly. The trailing surface extends outboard of the sidewall and faces downwardly and rearwardly. The leading and trailing surfaces of the sidewall control fins define a transversely extending edge at their intersections. The leading and trailing surfaces are preferably concave. It is believed that the concave curvature of the leading and trailing surfaces provides a hydro-dynamic lift which improves control and board performance generally. The transversely extending edge also may function as a convenient hand hold. The trailing surfaces preferably curve toward the base control fin beginning at a point intermediate the length of the sidewall and continues to curve toward the base control fin up to the transversely extending edge.

The sidewalls converge from the upper edge of the sidewalls to the base control fins relative to the center line of the body surfing board. It is important that the sidewalls are not perpendicular to the bottom of the body surfing board so that the person using the board may stabilize or balance over the sidewall while laying on the top of the body surfing board. The torso-receiving recess of the body surfing board is preferably a concave surface terminating in up-turned edges which overlie the sidewalls. The upturned edges provide a surface against which the persons weight may be exerted as it balances over the sidewall.

The body surfing board of the invention is easy to swim with and provides unprecedented directional control for body surfing floatation devices. With the improved body surfing board of the invention, body surfers can now challenge the waves to an extent previously only possible with conventional surf boards.

BEST MODE FOR CARRYING OUT THE INVENTION

Figure 1:
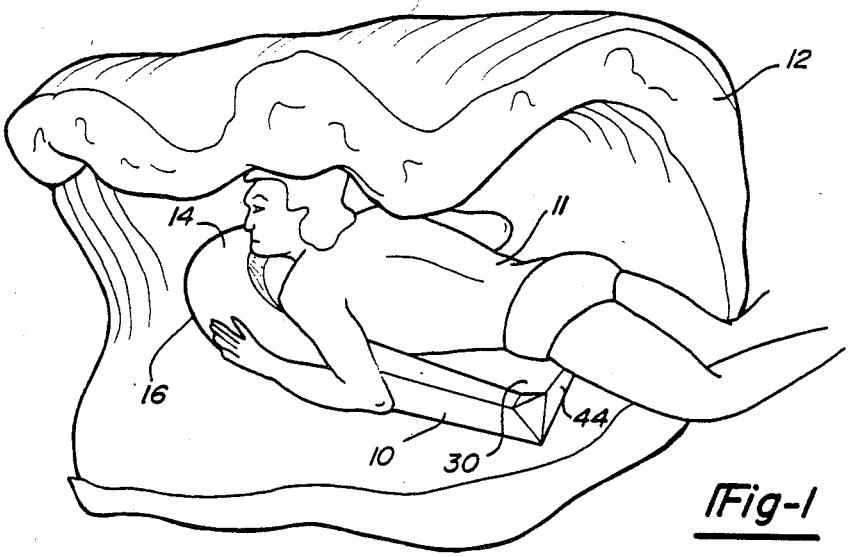
FIG. 1 is a perspective view of a person riding the body surfing board of the present invention on a wave.
Figure 2:
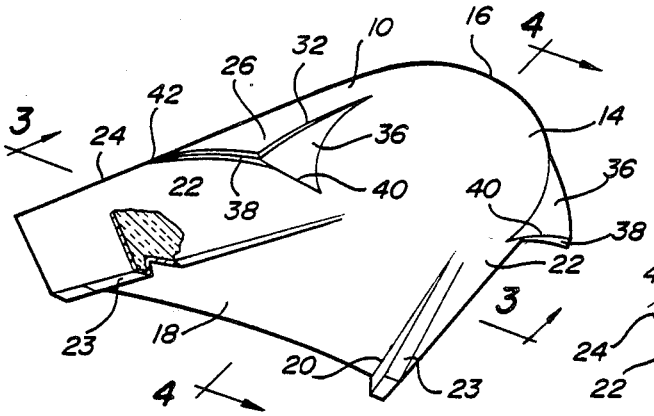
FIG. 2 is a perspective view of the bottom of the body surfing board of the present invention.

Referring now to FIGS. 1 and 2, a body surfing board 10 of the present invention is shown. In FIG. 1, the body surfing board is shown in use by a person 11 riding a wave 12.

The body surfing board includes a bulbous nose portion 14 at its forward end 16. The nose portion 14 is a partially spherical region rounded for maneuverability and of increased vertical height making the front end more buoyant.

The body surfing board 10 includes a bottom portion 18, as shown in FIG. 2, which extends rearwardly from the nose portion 14. The bottom portion 18 has lateral edges 20 at the intersection of the sidewalls 22 with the bottom portion 18. Base control fins 23 are provided on the bottom portion 18 at the lateral edges 20. The base control fins 23 are elongated ribs which taper downwardly from the bottom portion 18 beginning at the nose portion 14. The base control fins 23 diverge outwardly in the rearward direction.

The sidewalls 22 have upper edges 24 which are spaced from the base control fins 23 and are outboard of the base control fins so that the sidewalls 22 diverge outwardly from the base control fins to the upper edges 24.

Sidewall control fins 26 are provided on the forward end of the sidewalls 22 between the sidewalls 22 and the nose portion 14 at the intersection of the sidewalls 22 and the top surface 28 of the body surfing board 10.

One of the sidewalls 22 of the body surfing board 10 provides the primary contact with the wave when turning sharply into a wave. The sidewalls 22 are preferably arcuate in shape and are generated about two axes A and A' which converge toward the nose portion 14.

The sidewall control fins and base control fins provide two spaced edges that can be used for turning into or away from the wave when the body surfer is riding the board with his weight centered above one of the sidewalls 22. The convex curvature of the sidewalls 22 permits quick shifting from the base control fin 23 to the sidewall control fin 26. This quick maneuverability is important when the body surfing board is taken into the curl or tunnel of a wave.

Figure 3:
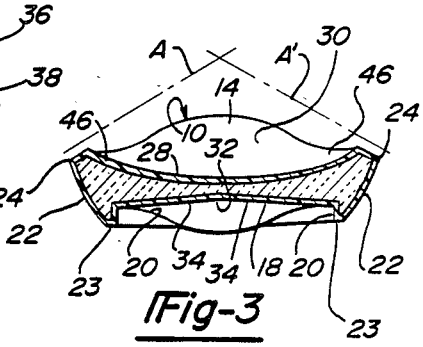
FIG. 3 is a cross sectional view taken along the line 3—3 in FIG. 2.
Figure 4:
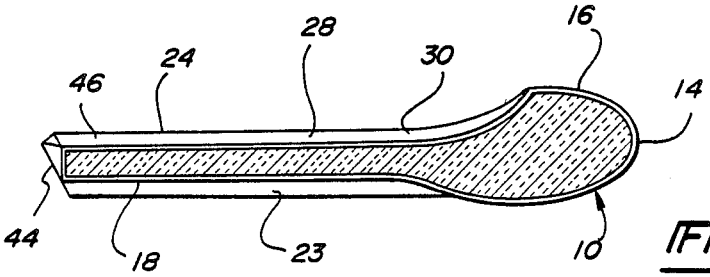
FIG. 4 is a cross sectional view taken along the line 4—4 in FIG. 3.

The top surface 28 includes a torso-receiving recess 30 as best shown in FIGS. 3 and 4. The torso-receiving recess is concave in shape.

The bottom portion 18 as shown in FIGS. 3 and 4 includes a central apex 32 between a pair of planar surfaces 34. The planar surfaces 34 and central apex 32 form a concave surface which provides a stable base for the body surfing board 10 when it is desirable to move the body surfing board forwardly. The sidewalls 22 extend below the planar surfaces 34. The base control fins 23 interconnect the lower ends of the sidewalls 22 and the respective planar surfaces 34, as shown in FIGS. 2 and 3.

In the preferred embodiment, the sidewall control fins 26 include a leading surface 36 which extends outboard from the nose portion 14 and face downwardly and forwardly. The leading surface 36 functions to direct water deflected by the nose portion 14 under the body surfing board 10. The leading surface 36 also provides a climbing edge 37 which helps the board climb the face of a wave when it engages the face of the wave. The sidewall control fins 26 also include a trailing surface 38 which extends rearwardly from the leading surface 36. The leading surface 36 and trailing surface 38 form a transverse edge 40 which extends generally transversely to the length of the body surfing board 10. The trailing surface 38 curves upwardly to a point 42 intermediate the length of the sidewall control fin 26. The leading surface 36 and trailing surface 38 are preferably slightly convex in shape. It is believed that the convex shape of the leading and trailing surfaces 36 and 38 adds to the effectiveness of the sidewall control fins 26.

As shown in FIGS. 1 and 4, the stern surface 44 is a transversely extending substantially planar surface.

The torso-receiving recess 30 is formed by the top surface 28 which preferably includes up-turned edges 46 on its lateral sides which are adjacent the sidewalls 22. When the body surfing board 10 is rolled to one side so that one of the sidewalls 22 is the primary riding surface and the weight of the person using the body surfing board is centered over the sidewalls 22 the body of the person using the body surfing board can bear against the up-turned edges 46 to control the board.

The corners and edges between the sidewalls 22 and the stern surface 44 may be beveled for aesthetic purposes and for the comfort of the user.

The preferred method of making the body surfing board 10 of the present invention is to form a shell 48 by roto-casting polypropylene in a die. The polypropylene is injected into the die as it spins. The shell 48 is then allowed to harden in the dye. Polyurethane foam is then injected through an opening to form a buoyant reinforcing core 52. The hole 50 is then sealed with polypropylene to complete the body surfing board 10. The polypropylene material used in the shell 48 is preferably a resilient polypropylene which gives the body surfing board a tough, smooth and slightly padded surface.

While it is apparent that the preferred embodiment of the invention disclosed above is intended to fulfill the objects stated above, it should be appreciated that the invention is susceptible to modification, variation and change without departing from the proper scope or fair meaning of the invention.

What is claimed is:

1. A body surfing board for riding water waves, the board being a rigid buoyant body comprising a nose portion at the forward end of the body, a bottom portion extending rearwardly from the nose portion, a pair of planar longitudinally extending and downwardly projecting base control fins formed on said bottom portion, said base control fins each having a lateral surface facing each other, a pair of sidewalls each extending rearwardly from the nose portion and upwardly from one of the base control fins, said sidewalls each having an upper edge, a pair of sidewall control fins each formed at the upper edge of its associated sidewall, a top surface extending rearwardly from the nose portion between the upper edges of the sidewalls, said top surface defining a torsoreceiving region behind the nose portion and between the sidewalls, said sidewall control fins and base control fins together facilitating steering said body surfing board.

2. The body surfing board of claim 1 wherein said nose portion is a partially spherical bulbous region from which the bottom portion, sidewalls and top surface extend rearwardly.

3. The body surfing board of claim 1 wherein said bottom portion has a central apex and two planar surfaces intersecting concavely at said apex and being disposed at an oblique angle relative to each other.

4. The body surfing board of claim 1 wherein said sidewalls are convexly curved between the base control fins and the sidewall control fins, said sidewalls each being substantially generated about an axis which converges with the axis of the other sidewall in the direction of the nose portion.

5. A body surfing board for riding water waves, the board being a rigid buoyant body comprising a nose portion at the forward end of the body, a bottom portion extending rearwardly from the nose portion, said bottom portion having a pair of longitudinally extending base control fins, a pair of sidewalls each extending rearwardly from the nose portion and upwardly from one of the base control fins, said sidewalls each having an upper edge, a pair of sidewall control fins each formed at the upper edge of its associated sidewall, said sidewall control fins each define a leading surface and a trailing surface, said leading surface extending outboard of the nose and facing downwardly and forward, said trailing surface extending outboard of the sidewall and facing downwardly and rearwardly, said leading and trailing surfaces defining transversely extending edges at their intersections, a top surface extending rearwardly from the nose portion between the upper edges of the sidewalls, said top surface defining a torso-receiving region behind the nose portion and between the sidewalls.

6. The body surfing board of claim 5 wherein said leading surfaces and said trailing surfaces are concave.

7. The body surfing board of claim 5 wherein said sidewall control fins each curve toward the base control fin at the bottom of the respective sidewall from a point intermediate the length of the sidewall to the transversely extending edge.

8. The body surfing board of claim 1 wherein said sidewalls are convergent from the upper edge of the sidewalls to the base control fins.

9. In the body surfing board of claim 1, a stern surface facing rearwardly and being substantially planar.

10. The body surfing board of claim 1 wherein said torso-receiving recess is a concave surface terminating in up-turned edges overlying the sidewalls.

11. A rigid buoyant body used by a person for riding water waves, the body having an enlarged portion at the forward end of the body, a pair of base control fins extending and diverging rearwardly from the enlarged portion and providing added buoyancy for the forward end of the body, a pair of convexly curved sidewalls each extending rearwardly from the nose portion and extending increasingly outboard from one of the base control fins, said sidewalls being oriented to permit the person to ride on the board balanced over the sidewall, said sidewalls each having an upper edge, a pair of sidewall control fins each formed at the upper edge of its associated sidewall, said base control fins and sidewall control fins providing turning edges for bidirectional control when the person is balanced over the sidewall, a top surface extending rearwardly from the nose portion, between the upper edges of the sidewalls, said top surface defining a torso-receiving recess having upwardly curved edges adjacent the sidewalls, said upwardly curved edges being adapted to receive the weight of the person riding the board at different angular orientations to provide turning control with the base control fins and the sidewall control fins.

12. The body surfing board of claim 11 wherein said enlarged portion is a bulbous region from which a bottom portion, said sidewalls and said top surface extend rearwardly.

13. The body surfing board of claim 12 wherein said bottom portion has a central apex and two planar surfaces intersecting concavely at said apex and being disposed at an oblique angle relative to each other.

14. The body surfing board of claim 11 wherein said sidewalls are convexly curved between the base control fins and the sidewall control fins, said sidewalls each being substantially generated about an axis which converges with the axis of the other sidewall in the direction of the nose portion.

15. The body surfing board of claim 11 wherein said sidewall control fins each define a leading surface and a trailing surface, said leading surface extending outboard of the nose and facing downwardly and forwardly, said trailing surface extending outboard of the sidewall and facing downwardly and rearwardly, said leading and trailing surfaces defining transversely extending edges at their intersections.

16. The body surfing board of claim 15 wherein said leading surfaces and said trailing surfaces are concave.

17. The body surfing board of claim 15 wherein said sidewall control fins each curve toward the base control fin at the bottom of the respective sidewall from a point intermediate the length of the sidewall to the transversely extending edge.

18. The body surfing board of claim 11 wherein said sidewalls are convergent from the upper edge of the sidewalls to the base control fins.

19. In the body surfing board of claim 11, a stern surface facing rearwardly and being substantially planar.

20. The body surfing board of claim 11 wherein said torso-receiving recess is a concave surface terminating in up-turned edges overlying the sidewalls.

* * * * *